US005352097A

United States Patent [19]

Itou et al.

[11] Patent Number: 5,352,097

[45] Date of Patent: Oct. 4, 1994

[54] VACUUM PUMP

[75] Inventors: Daisuke Itou, Yao; Teruo Maruyama, Hirakata, both of Japan

[73] Assignee: Matsushita Electric Industrial Co., Ltd., Osaka, Japan

[21] Appl. No.: 6,500

[22] Filed: Jan. 21, 1993

[30] Foreign Application Priority Data

Jan. 23, 1992 [JP] Japan ..... 4-009736

[51] Int. Cl.[5] ..... F04C 25/02

[52] U.S. Cl. ..... 417/42; 417/203; 417/205

[58] Field of Search ..... 417/203, 205, 42, 45; 415/71

[56] References Cited

U.S. PATENT DOCUMENTS

| | | | |
|---|---|---|---|
| Re. 17,689 | 6/1930 | Hibbard . | |
| 2,243,874 | 6/1941 | Lysholm . | |
| 2,640,428 | 6/1953 | Houghton . | |
| 3,639,087 | 2/1972 | Frohbieter . | |
| 3,811,805 | 5/1974 | Moody, Jr. et al. . | |
| 4,152,092 | 5/1979 | Swearingen . | |
| 4,420,291 | 12/1983 | Winstead . | |
| 4,625,156 | 11/1986 | Komiya et al. . | |
| 4,712,048 | 12/1987 | Rebsamen . | |
| 4,758,132 | 7/1988 | Hartwig . | |
| 4,797,068 | 1/1989 | Hayakawa et al. . | |
| 4,808,077 | 2/1989 | Kan et al. . | |
| 4,829,217 | 5/1989 | Kameyama et al. . | |
| 4,850,806 | 7/1989 | Morgan et al. . | |
| 5,062,771 | 11/1992 | Satou et al. . | |
| 5,115,172 | 5/1992 | Ishii et al. . | |
| 5,118,251 | 6/1992 | Saulgeot . | |
| 5,166,566 | 11/1992 | Bernhardt et al. . | |
| 5,197,861 | 3/1993 | Maruyama et al. | 417/203 X |

FOREIGN PATENT DOCUMENTS

| | | | |
|---|---|---|---|
| 0221003 | 5/1987 | European Pat. Off. | |
| 0256234 | 6/1987 | European Pat. Off. | |
| 0230868 | 8/1987 | European Pat. Off. | |
| 0340658 | 4/1989 | European Pat. Off. | |
| 0382029 | 8/1990 | European Pat. Off. | |
| 0435291 | 12/1990 | European Pat. Off. | |
| 3153474 | 6/1973 | Fed. Rep. of Germany . | |
| 3230550 | 1/1984 | Fed. Rep. of Germany . | |
| 60-259791 | 12/1985 | Japan . | |
| 62-314056 | 6/1989 | Japan . | |
| 1530813 | 12/1989 | U.S.S.R. | 417/203 |
| 809445 | 2/1959 | United Kingdom . | |
| 2123089 | 1/1984 | United Kingdom . | |

OTHER PUBLICATIONS

"A General Performance Computer Program for Oil Flooded Twin-Screw Compressor", Pawan J. Singh and Ghanshyam C., Patel, Ingersoll-Rand Research, Inc. Princeton, N.J., 1984, pp. 544-553.

"Computer Modeling For Performance Analysis of Rotary Screw Compressor": Mitsuru Fujiwara and Katsuhiko Kasuya, Mechanical Engineering Research Laboratory, Hitachi, Ltd., Ibaraki, Japan, 1984, pp. 536-543.

"A New Molecular Pump": , Louis Maurice, Proc. 6th Interl. Vacuum Congr. 1974 Japan, J. Appl. Phnys. Suppl. 2, Pt. 1, 1974.

Patent Abstracts of Japan "Multichannel Type Vacuum Pump", vol. 13, No. 225 (M-830) [357], May 25, 1989.

*Primary Examiner*—Richard E. Gluck

*Attorney, Agent, or Firm*—Wenderoth, Lind & Ponack

[57] ABSTRACT

A vacuum pump includes a positive displacement vacuum pump structure section disposed on a discharge opening side; a kinetic vacuum pump structure section, disposed on a suction opening side, for providing a high vacuum; and a kinetic vacuum pump structure section, disposed on a suction opening side, for providing a high pumping speed. The construction of the kinetic vacuum pump structure section is different from that of the kinetic vacuum pump structure section so as to differ relative thereto in one of ultimate pressure, pumping speed, and pumping speed of sucked gas with respect to a molecular weight of the sucked gas.

5 Claims, 11 Drawing Sheets

*Fig. 9* - PRIOR ART
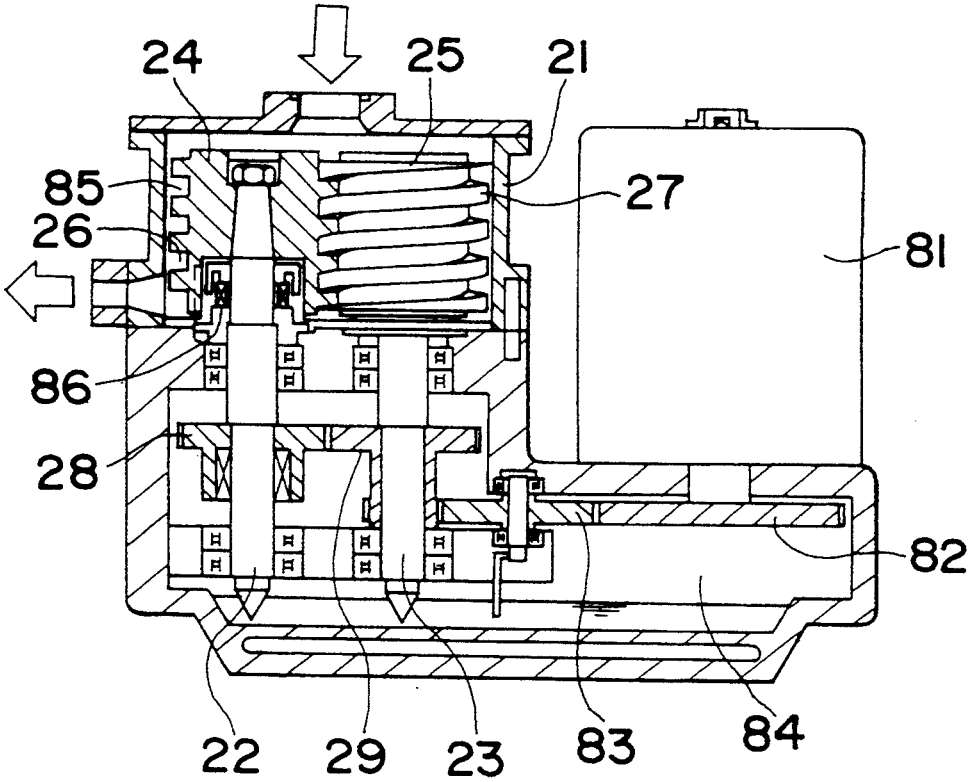

Fig. 10 - PRIOR ART
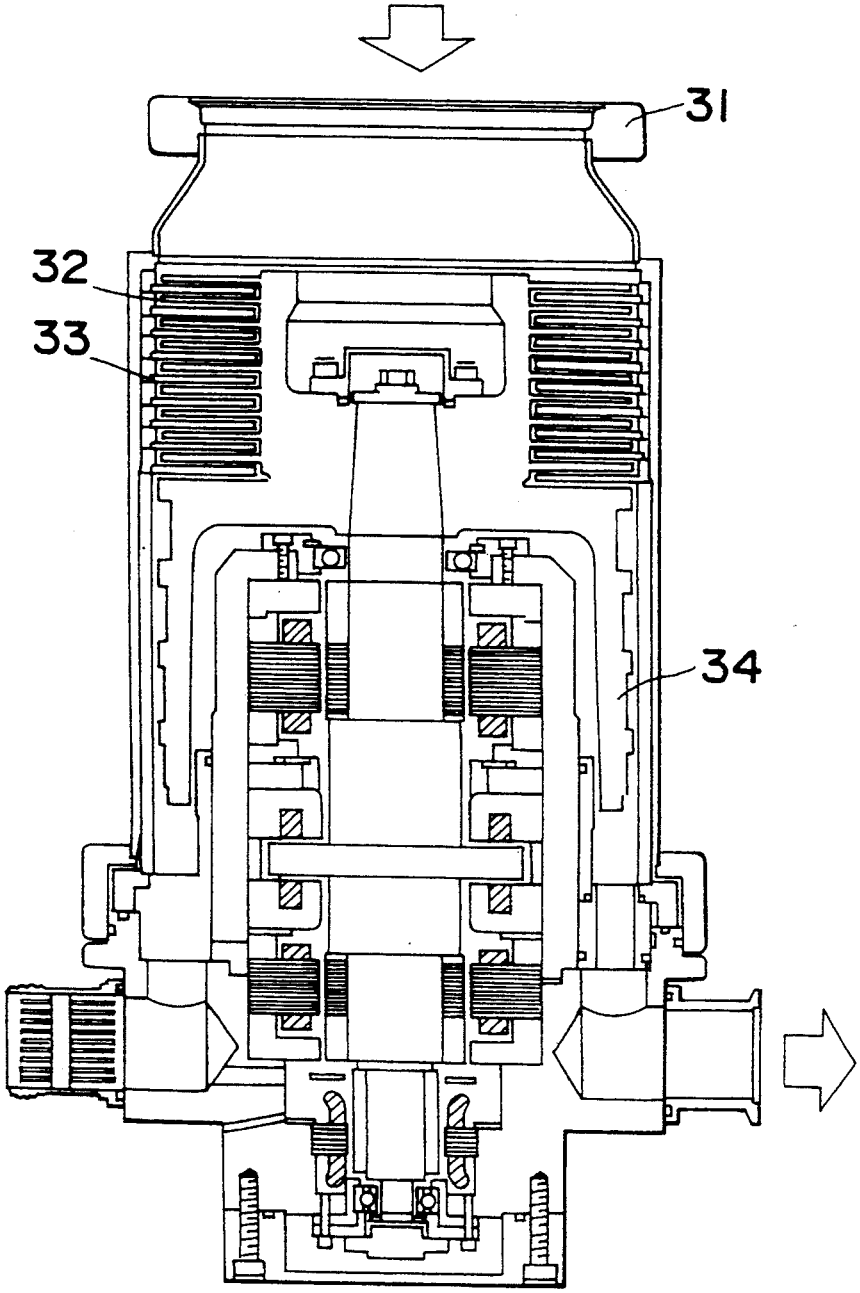

VACUUM PUMP

BACKGROUND OF THE INVENTION

The present invention relates to a vacuum pump to be used to discharge gas from a vacuum chamber installed on an equipment for manufacturing semiconductors.

A vacuum pump for generating a vacuum environment is indispensable for a CVD apparatus, a dry etching apparatus, a sputtering apparatus, and an evaporating apparatus. In recent years, the demand for vacuum pump having high operational performance has become stronger and stronger because the process of manufacturing semiconductors must to be clean and have a high vacuum.

FIG. 9 shows an example of a screw type vacuum pump which is classified as a conventional positive displacement vacuum pump. The vacuum pump comprises a housing 21; a first rotary shaft 22; a second rotary shaft 23; cylindrical rotors 24 and 25 supported by the first rotary shaft 22 and the second rotary shaft 23, respectively; and thread grooves 26 and 27 formed on the peripheral surfaces of the rotors 24 and 25, respectively. That is, the conventional screw type vacuum pump comprises the first rotary shaft 22 and the second rotary shaft 23, parallel with each other, and accommodated in the housing 21; the rotors 24 and 25 mounted on the rotary shafts 22 and 23, respectively; and the thread grooves 26 and 27 formed on the rotors 24 and 25, respectively to form screws. A space is formed between the thread grooves 26 and 27 by engagement between the groove of the thread groove 26 and the thread of the thread groove 27 and between the thread of the thread groove 26 and the groove of the thread groove 27. As a result of the rotation of the rotors 24 and 25, the volume of the space changes and thus suction and discharge (pumping) operations are performed. In this vacuum pump, the synchronous rotation of the rotors 24 and 25 is carried out by the operation of the timing gears 28 and 29. That is, the rotation of a motor 81 is transmitted from a driving gear 82 to an intermediate gear 83 and then to the timing gear 29 mounted on the shaft of the rotor 25. The phase between the rotational angles of the rotors 24 and 25 is adjusted by engagement between the timing gears 28 and 29. Lubricating oil 84 filled in a mechanical operating chamber accommodating the above gears transmitting the power of the motor 81 and rotating the rotors 24 and 25 synchronously is forcibly supplied to the gears. A mechanical seal 86 is provided between a fluid-operating chamber 85 accommodating the rotors 24, 25 and the mechanical operating chamber 85 so as to prevent the lubricating oil 84 from penetrating into the fluid-operating chamber 85.

FIG. 10 shows a conventional thread groove type vacuum pump, having a turbine blade, which is classified into a kinetic vacuum pump. The vacuum pump comprises a housing 31; a cylindrical rotor 32; a turbine blade 33; and a thread groove 34. That is, the conventional thread groove type vacuum pump has the rotor 32 in the housing 31; the turbine blade 33 disposed at an upper portion of a side portion of the rotor 32; and the thread groove 34 disposed below the rotor 32. Each member imparts momentum to gas molecules, thus performing section and discharge operations.

The conventional positive displacement vacuum pump discharges gas in the viscous flow region, the pressure of which is near atmospheric pressure, but the operational range thereof is as low as approximately $10^{-1}$ Pa. The operational range of the conventional thread groove type vacuum pump having the turbine blade is as high as approximately $10^{-8}$ Pa, but the thread groove type vacuum pump is incapable of discharging gas in the viscous flow region, the pressure of which is near atmospheric pressure. Therefore, a roughing operation is performed to a degree of $10^{0}$ to $10^{-1}$ Pa by a rotary pump (a to positive displacement vacuum pump) and then, a predetermined high vacuum is generated by a turbo pump (a to kinetic vacuum pump).

With the progress of composite semiconductor processing in recent years, multi-chamber systems for evacuating a plurality of vacuum chambers independently of each other has been mainly adopted. Evacuating equipment is required for each chamber in order to adopt the multi-chamber system. But the use of two kinds of vacuum pumps leads to a large evacuating apparatus.

One of the present inventors has already proposed a vacuum pump comprising a kinetic vacuum pump structure section and a positive displacement vacuum pump structure section comprising a plurality of shafts. The kinetic vacuum pump structure section is disposed on one of the shafts for driving rotors of the positive displacement vacuum pump structure section. A plurality of the shafts is controlled so that the shafts rotate synchronously. The vacuum pump generates a vacuum in a wide range from atmospheric pressure to a high vacuum.

SUMMARY OF THE INVENTION

It is an object of the present invention to provide a vacuum pump which is compact and capable of generating vacuums in a wide range from atmospheric pressure to a high vacuum and pumping gas at a high speed.

In accomplishing this and other objects of the present invention, there is provided a vacuum pump comprising:

- a plurality of rotors accommodated in a housing;
- a plurality of bearings for respectively supporting rotary shafts of the rotors;
- a fluid-suction opening and a fluid-discharge opening formed in the housing;
- a plurality of motors for respectively driving the rotors, respectively; and
- a plurality of control means for respectively controlling the motors so that the motors rotate synchronously, whereby fluid is sucked and discharged by utilizing changes in the volume of a space formed by the rotors and the housing;
- a positive displacement vacuum pump structure section disposed on the discharge side of each rotor; and
- a plurality of kinetic vacuum pump structure sections disposed on the section side of each rotor, in which:
- the kinetic vacuum pump structure sections are different in one of ultimate pressure, pumping speed, and pumping speed of sucked gas with respect to a molecular weight of the sucked gas.

According to the above-described construction, each of a plurality of kinetic vacuum pump structure sections is disposed on one of the rotors of the positive displacement vacuum pump structure section which comprises a plurality of rotors and a housing. The kinetic vacuum pump structure sections are different from each other in one of the characteristics of ultimate pressure, pumping speed, and pumping speed of sucked gas having a different molecular weight. Therefore, the vacuum pump according to the present invention generates a high vacuum and a high pumping speed unlike the conventional vacuum pump.

More specifically, for example, one of the kinetic vacuum pump structure sections may be so configured as to obtain a high vacuum and the other of the kinetic vacuum pump structure section may be so configured as to obtain a high pumping speed. Further, a suction opening may be formed in each kinetic vacuum pump structure section. In this state, a great pumping speed can be obtained by opening the suction opening of each kinetic vacuum pump structure section. Then, gas discharge may be continued with the suction opening of the kinetic vacuum pump structure section which provides a high pumping speed closed and with the suction opening of the kinetic vacuum pump structure section which provides a high vacuum opened. In this manner, a higher vacuum can be obtained.

At least one of the kinetic vacuum pump structure sections may comprise a turbine blade functioning as a means for imparting momentum to gas molecules. Thus, a much higher vacuum can be obtained.

BRIEF DESCRIPTION OF THE DRAWINGS

These and other objects and features of the present invention will become clear from the following description taken in conjunction with the preferred embodiments thereof with reference to the accompanying drawings, in which:

FIG. 9 is a sectional view showing a conventional screw type vacuum pump: and FIG. 10 is a sectional view showing a conventional thread groove type vacuum pump having a turbine blade.

DETAILED DESCRIPTION OF THE INVENTION

Figure 1:
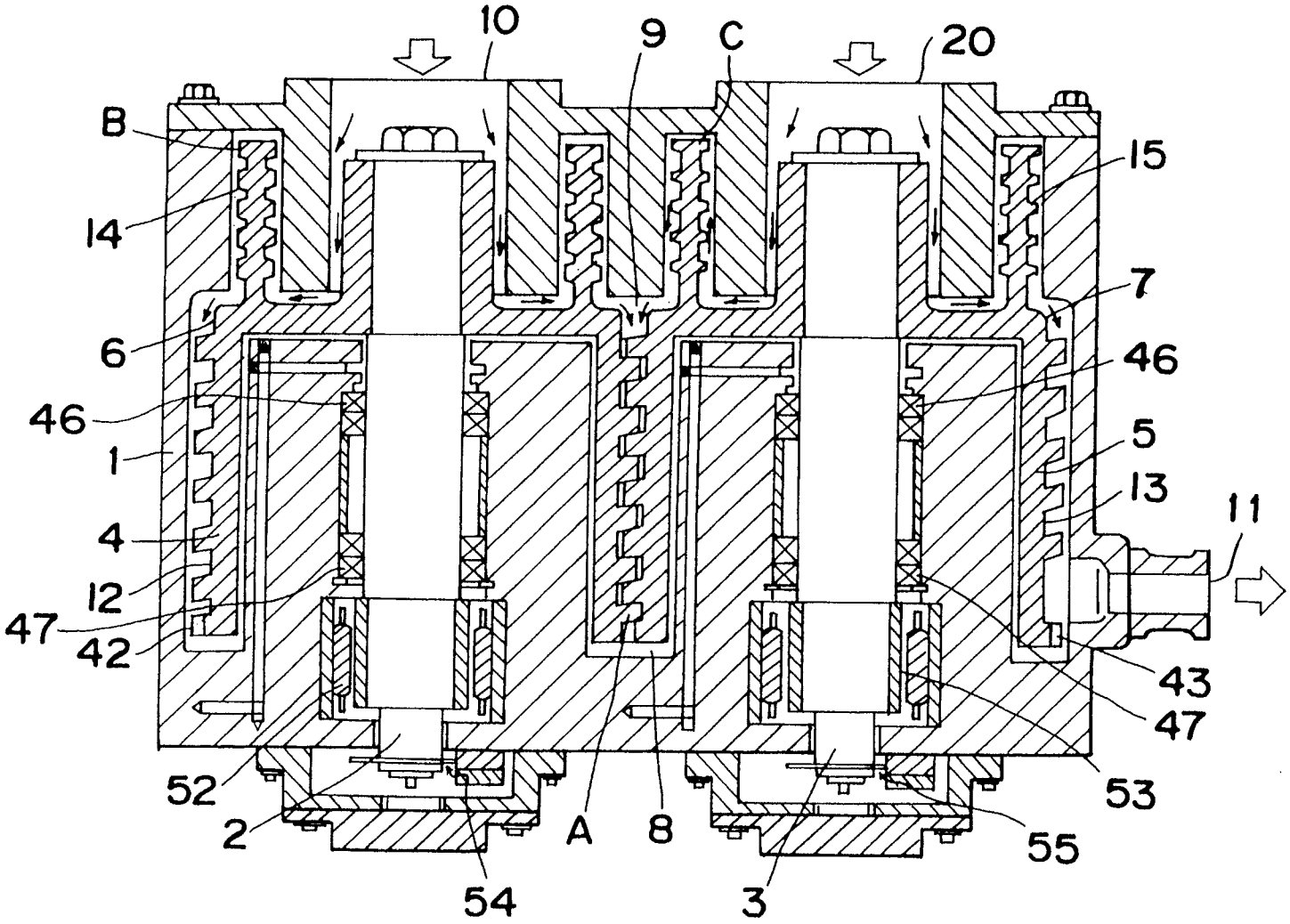
FIG. 1 is a sectional view showing a vacuum pump according to a first embodiment of the present invention.

Before the description of the present invention proceeds, it is to be noted that like parts are designated by like reference numerals throughout the accompanying drawings.

With reference to FIGS. 1 through 6, a vacuum pump according to a first embodiment will be described below.

Figure 2:
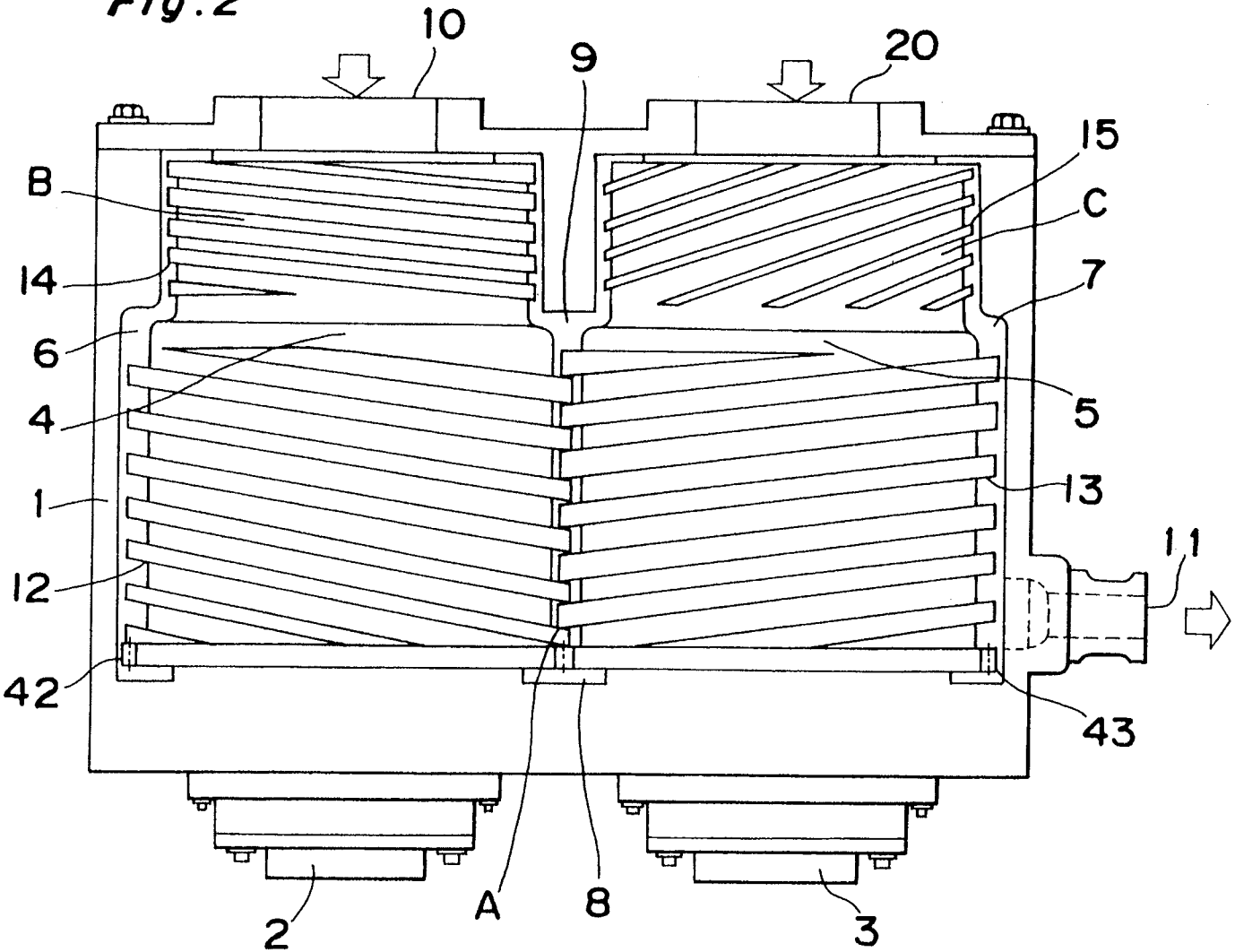
FIG. 2 is a side elevation showing the vacuum pump according to the first embodiment of the present invention.

With reference to FIGS. 1 and 2, the vacuum pump comprises a positive displacement vacuum pump structure section (A), a kinetic vacuum pump structure section (B), and a kinetic vacuum pump structure section (C). More specifically, the kinetic vacuum pump structure section (B) is provided to generate a high vacuum. The kinetic vacuum pump structure section (C) is provided to generate a high pumping speed. The vacuum pump comprises a housing 1; a first rotary shaft 2 accommodated in the housing 1; a second rotary shaft 3, accommodated in the housing 1, parallel with the first rotary shaft 2; a cylindrical rotor 4 corresponding to the first rotary shaft 2; a cylindrical rotor 5 corresponding to the second rotary shaft 3; a first chamber 6 corresponding to the first rotary shaft 2; a second chamber 7 corresponding to the second rotary shaft 3; a communicating section 8 through which the first chamber 6 and the second chamber 7 communicate with each other in a lower portion thereof; a communicating section 9 through which the first chamber 6 and the second chamber 7 communicate with each other in an upper portion thereof; a suction opening 10 disposed above the kinetic vacuum pump structure section (B); a suction opening 20 disposed above the kinetic vacuum pump structure section (C); a discharge opening 11 disposed on a side of the positive displacement vacuum pump structure section (A); a thread groove 12, of the positive displacement vacuum pump structure section (A), corresponding to the first rotary shaft 2; a thread groove 13, of the positive displacement vacuum pump structure section (A), corresponding to the second rotary shaft 3; a thread groove 14 of the kinetic vacuum pump structure section (B); and a thread groove 15 of the kinetic vacuum pump structure section (C). The kinetic vacuum pump structure section (B) and the kinetic vacuum pump structure section (C) are hereinafter referred to as the high vacuum-generating pump (B) and the high pumping speed pump (C), respectively.

The vacuum pump having the above-described construction has the housing 1 divided into the first chamber 6 and the second chamber 7. The vertically extending first rotary shaft 2 is accommodated in the first chamber 6 and the second rotary shaft 3 parallel with the first rotary shaft 2, is accommodated in the second chamber 7. The first and second rotary shafts 2 and 3 are supported by bearings 46 and 47, respectively. The rotors 4 and 5 supported in the vicinity of the upper ends of the first and second rotary shafts 2 and 3 are connected with each other in a space formed by the upper ends of each of the first and second rotary shafts 2 and 3. Thread grooves 12 and 13 formed on the peripheral surfaces of the lower portions of the rotors 4 and 5, respectively, engage each other above the communicating section 8 which communicates the first chamber 6 second with the chamber 7 with each other. The volume of a space formed between the thread grooves 12 and 13 is changed cyclically by the rotation of the first and second rotary shafts 2 and 3. As a result, a discharge operation is performed. That is, the housing 1 accommodates the positive displacement vacuum pump structure section (A) comprising the rotor 4 having the thread groove 12 and the rotor 5 having the thread groove 13. A slight interval is formed between the rotor 4 disposed in the upper portion of the positive displacement vacuum pump structure section (A) and the inner wall of the first chamber 6 and between the rotor 5 and the inner wall of the second chamber 7. Rotary motion is imparted to gas molecules disposed in the slight interval due to the high speed-rotation of the first and second rotary shafts 2 and 3. As a result, the gas molecules are fed to the positive displacement vacuum pump structure section (A). The thread grooves 14 and 15 disposed above the rotors 4 and 5, respectively, impart drag to the gas molecules. That is, the high vacuum-generating pump (B) comprising the rotor 4 having the thread groove 14, and the high pumping speed pump (C) comprising the rotor 5 having the thread groove 15 are disposed on the upper portion of the positive displacement vacuum pump structure section (A) accommodated in the housing 1. The high vacuum-generating pump (B) and the high pumping speed pump (C) also act as a viscous pump having an effect of feeding gas, the pressure of which is near atmospheric pressure. The communicating section 9 is formed above the center of the positive displacement vacuum pump structure section (A). The suction opening 10 is located above the high vacuum-generating pump (B). The suction opening 20 is disposed above the high pumping speed pump (C). The discharge opening 11 is disposed on a side of the positive displacement vacuum pump structure section (A) on the peripheral lower portion of either the rotor 4 or the rotor 5.

Figure 4:
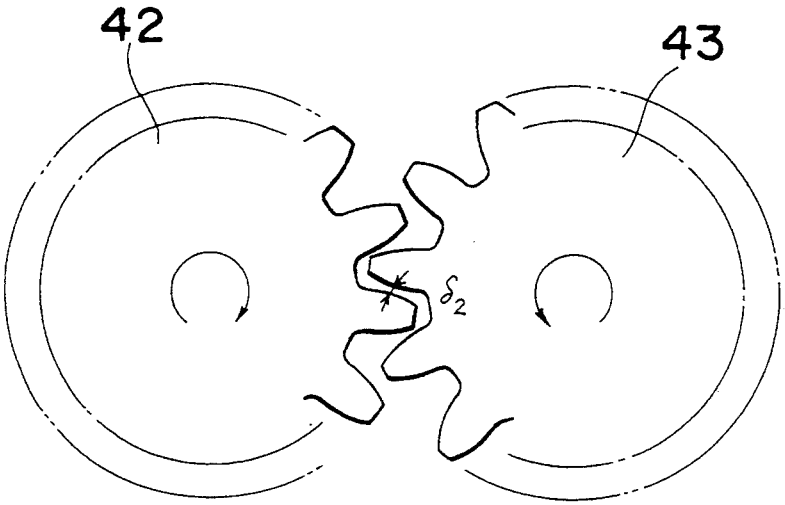
FIG. 4 is a plan view showing contact-preventing gears according to the first embodiment of the present invention.

Contact-preventing gears 42 and 43 shown in FIG. 4 for preventing contact between the thread grooves 12 and 13 are formed on the peripheral lower ends of the rotors 4 and 5, respectively. A solid lubricating film is formed on the contact-preventing gears 42 and 43 so that they can withstand possible contact between the metal of the contact-preventing gear 42 and that of the contact-preventing gear 43. The backlash gap $\delta_2$ between a tooth of the contact-preventing gear 42 and the mating tooth of the contact-preventing gear 43 is smaller than the backlash gap $\delta_1$ (not shown) between a tooth of the thread groove 12 and the mating tooth of the thread groove 13 formed on the peripheral surfaces of the rotors 4 and 5, respectively. Therefore, the contact-preventing gears 42 and 43 do not contact each other when the first and second rotary shafts 2 and 3 are rotating synchronously, whereas if they are rotating non-synchronously, the contact-preventing gears 42 and 43 contact each other before the thread grooves 12 and 13 contact each other. In this manner, the contact-preventing gears 42 and 43 prevent contact between the thread grooves 12 and 13. There is a possibility that a material cannot be practically processed in such a critical tolerance if the backlash gaps $\delta_2$ and $\delta_1$ are slight. It is noted, however, that the total leakage amount of fluid during one process of the pump is proportional to the period of time required for one process to be completed. Therefore, when the first and second rotary shafts 2 and 3 rotate at high speed, the performance (ultimate pressure) of the vacuum pump can be maintained sufficiently, even though the backlash gap $\delta_1$ is large in an allowable range. According to the vacuum pump, the first and second rotary shafts can be rotated at high speed. Thus, the backlash gaps $\delta_2$ and $\delta_1$ having a dimension necessary for preventing contact between the thread grooves 12 and 13 can be obtained, even though the backlash gaps $\delta_2$ and $\delta_1$ are processed with an ordinary accuracy.

The rotors 4 and 5 are respectively rotated at high speeds of tens of thousands of times per minute by servo motors 52 and 53 independently driven and disposed at lower portions of the first and second rotary shafts 2 and 3, respectively, by maintaining constant the ratio between the number of rotations of the rotors 4 and 5 determined by the ratio between the outer diameters thereof. Since the synchronous rotation of the rotors 4 and 5 is electronically controlled by the servo motors 52 and 53, respectively, it is unnecessary to provide the vacuum pump of the present invention with timing gears serving as the means for controlling the synchronous rotation of the rotors, unlike the conventional positive displacement vacuum pump described previously. Therefore, the vacuum pump of the present invention can be rotated at a speed of tens of thousands of times per minute, whereas the conventional positive displacement vacuum pump is rotated at a speed of as low as thousands of times per minute. According to the kinetic vacuum pump, it is necessary to rotate the rotor at tens of thousands of times per minute to obtain a large pumping speed in a region of a high vacuum. As apparent from the foregoing description the vacuum pump of the present invention allows the synchronous rotation of the rotors to be electronically controlled, and incorporates the positive displacement vacuum pump and the kinetic vacuum pump.

Figure 6:
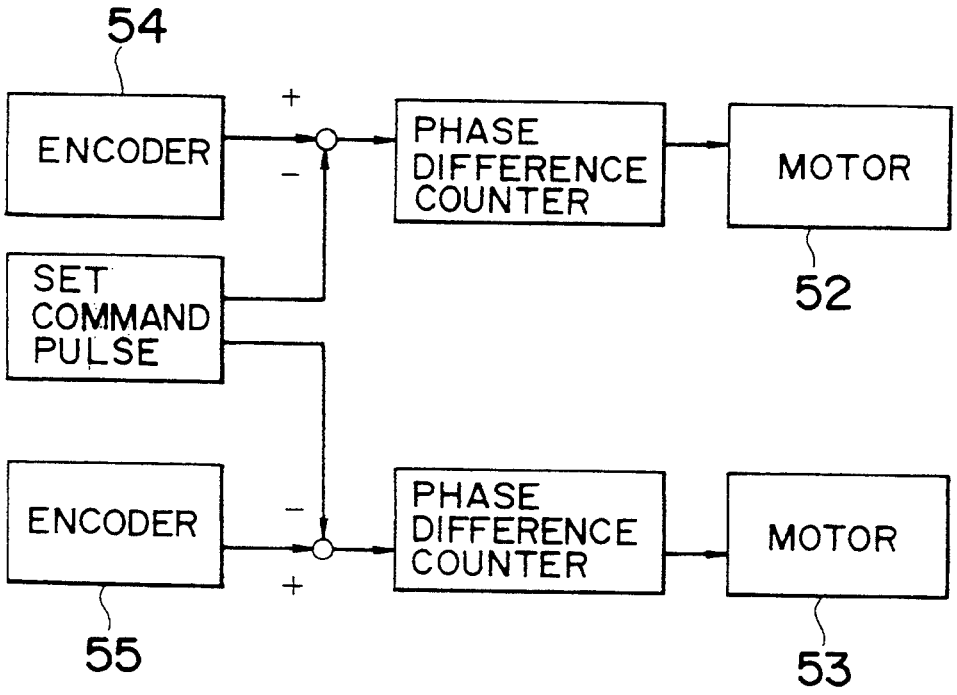
FIG. 6 is a block diagram of a method, according to one embodiment of the present invention, for controlling rotors so that the rotors rotate synchronously.

The PLL synchronous control of the first and second rotary shafts 2 and 3 is carried out by a method as shown in FIG. 6. Rotary encoders 54 and 55 are disposed at the lower ends of the first and second rotary shafts 2 and 3, respectively, as shown in FIG. 1. The output pulses of the rotary encoders 54 and 55 are compared with a predetermined instruction pulse (target value). A phase-difference counter calculates each deviation between the target value and the output value (number of rotations and rotational angle) of each of the first and second rotary shafts 2 and 3. Based on the calculated result, the rotation of each of the servo motors 52 and 53 is controlled so as to erase the deviation.

Figure 5:
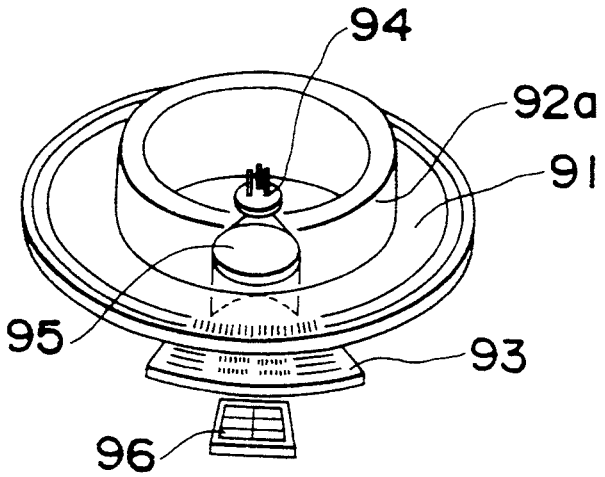
FIG. 5 is a perspective view showing a laser type encoder according to the first embodiment of the present invention.

As the rotary encoders 54 and 55, magnetic encoders or a conventional optical encoder may be used. In this embodiment, a laser type encoder having high resolution and high speed response and operated by utilizing the diffraction and interference of light is used. FIG. 5 shows an example of the laser type encoder. A moving slit plate 91 having a plurality of slits circularly formed thereon is rotated by shafts **92*a* and 92*b* connected with the first rotary shaft 2 and the second rotary shaft 3, respectively. A fixed slit plate 93 opposed to the moving slit plate 91 has slits formed in the configuration of a fan. Beams emitted by a laser diode 94 pass through a collimator lens 95 and are then received by a light-receiving element 96 through the slits of each of the slit plates 91 and 93**.

Figure 3:
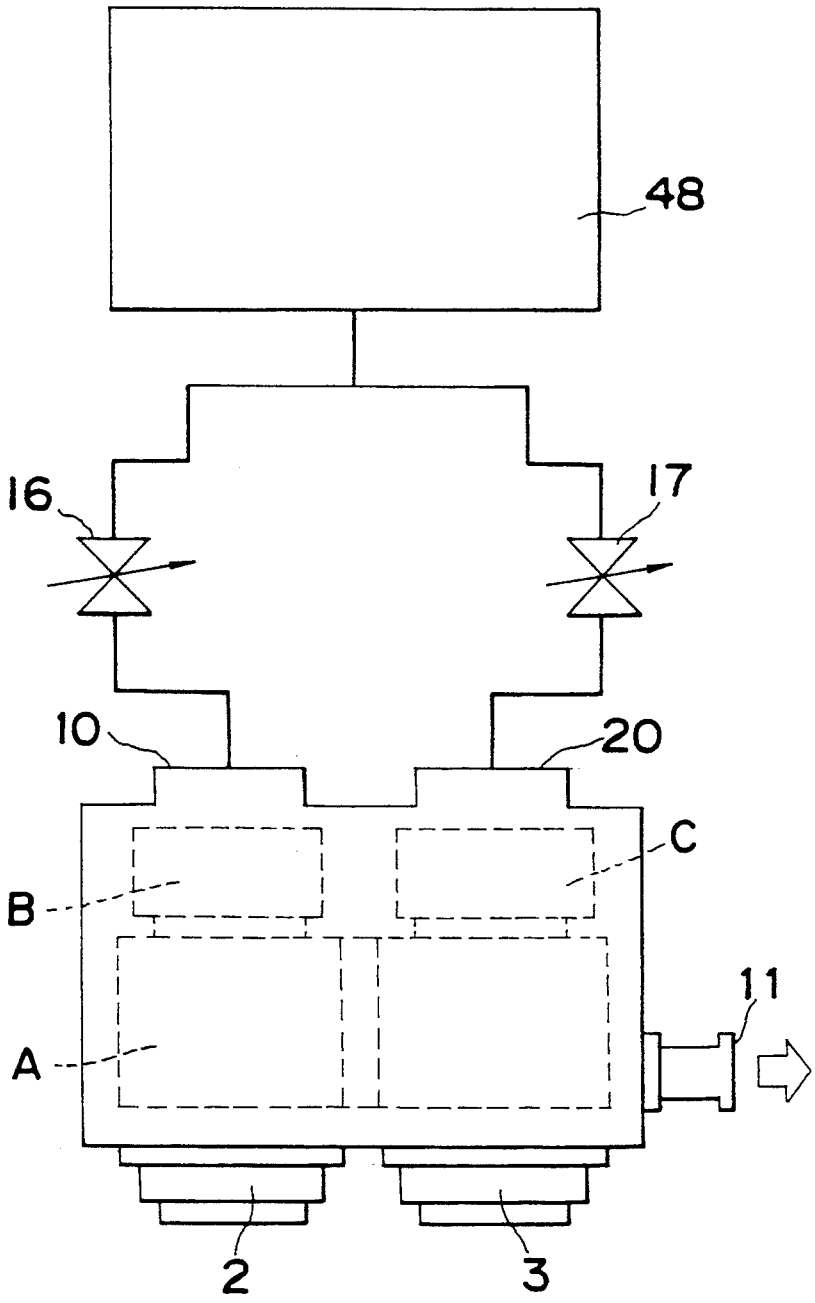
FIG. 3 is a schematic view showing the vacuum pump according to the first embodiment of the present invention.

As shown schematically in FIG. 3, opening/closing type valves 16 and 17 are disposed above the high vacuum-generating pump (B) and the high pumping speed pump (C), respectively. The valves 16 and 17 are opened so as to perform a roughing operation to a lower vacuum such as $10^{-1}$ to $10^{-2}$ Pa to obtain a high pumping speed, and then, a high vacuum ranging from $10^{-6}$ to $10^{-7}$ Pa, for example, is obtained. Preferably, only the valve 17 corresponding to the high pumping speed pump (C) is closed to generate a higher vacuum. The high vacuum-generating pump (B) and the high pumping speed pump (C) are designed by using dimensions and parameters as shown below.

The diameter of the rotor of the high vacuum-generating pump (B) is 130 mm and the length of the rotor is 100 mm. As parameters, the radial clearance between the rotors is 0.25 mm; the depth of the thread groove is 3.75 mm; the width of the thread groove is 22.5 mm; the width of the thread is 2.5 mm; and the number of threads is 5. The ultimate pressure of the pump is $1.60\times10^{-9}$ and the pumping speed thereof is 22.1l/min.

The diameter of the rotor of the large pumping speed pump (C) is 130 mm and the length of the rotor is 100 mm. As parameters, the radial clearance between the rotors is 0.5 mm; the depth of the thread groove is 10 mm, the width of the thread groove is 60 mm; the width of the thread is 3 mm; and the number of threads is 6. The ultimate pressure of the pump is $1.80\times10^{-1}$ and the pumping speed thereof is 110l/min.

The pump is operated in the following condition: the number of rotations is 20,000 rpm and the discharge pressure is 1 Pa.

The conventional pump has the following disadvantages: if the structure of the pump is selected to obtain a high vacuum, for example, if the depth of the thread groove is made small to obtain a high vacuum, a high pumping speed cannot be obtained. If the depth the thread groove is made to be great to obtain a high pumping speed, a desired ultimate pressure cannot be obtained. If the diameter of the rotor is made to be great to obtain both a high vacuum and a high pumping speed, a compact pump cannot be obtained and the characteristic frequency of each rotary shaft is low and as a result, the rotary shafts cannot be rotated at a high speeds. According to the present invention, the housing accommodates the positive displacement vacuum pump and two kinetic vacuum pumps provided above the positive displacement vacuum pump, the parameters of the groove configuration being different from each other in the two kinetic vacuum pumps. Accordingly, as apparent from the performance shown in the above-described parameters, the pump is compact and a high vacuum and a high pumping speed can be obtained.

Figure 7A:
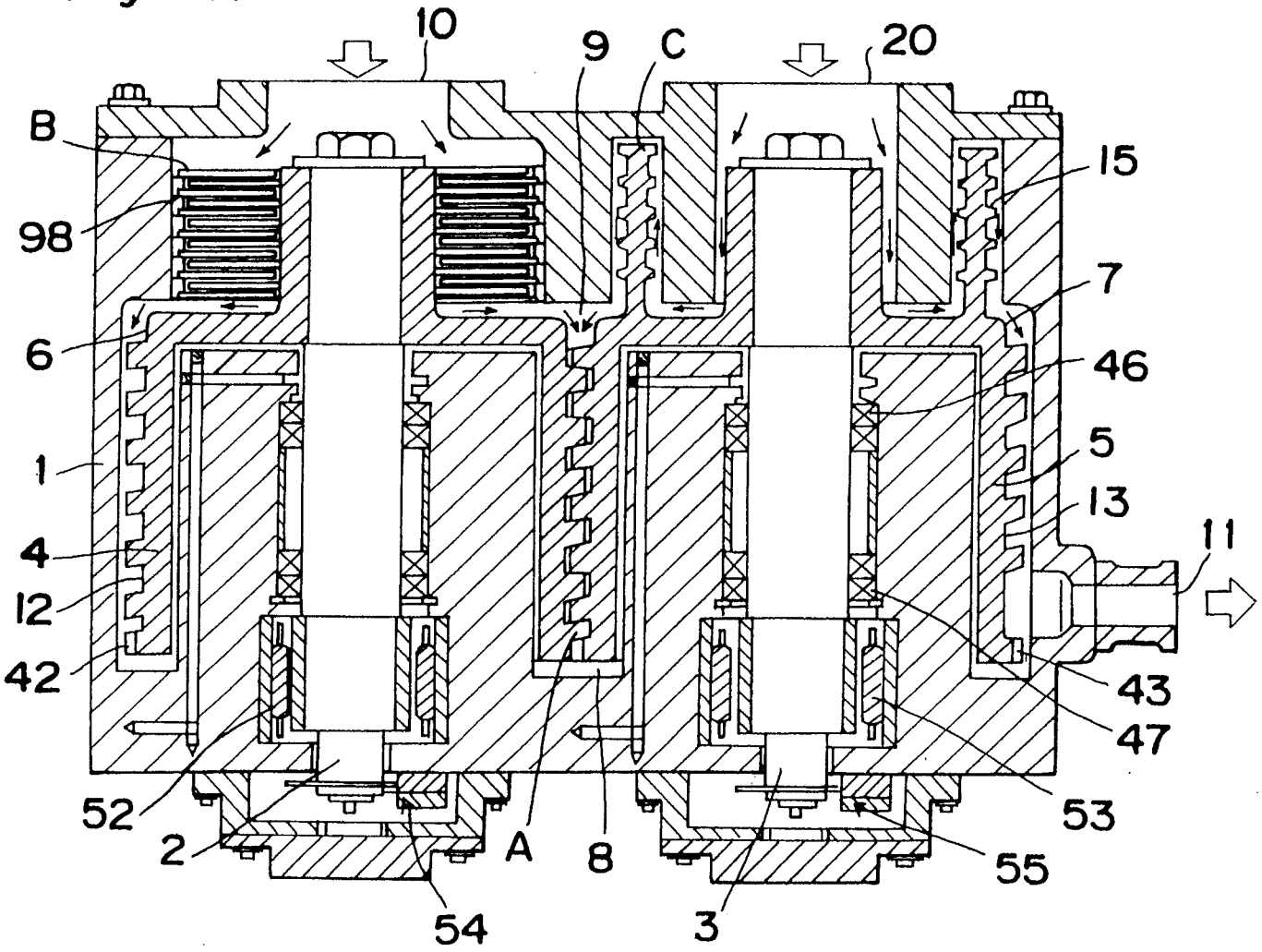
FIG. 7A is a sectional view showing a vacuum pump according to a second embodiment of the present invention.
Figure 7B:
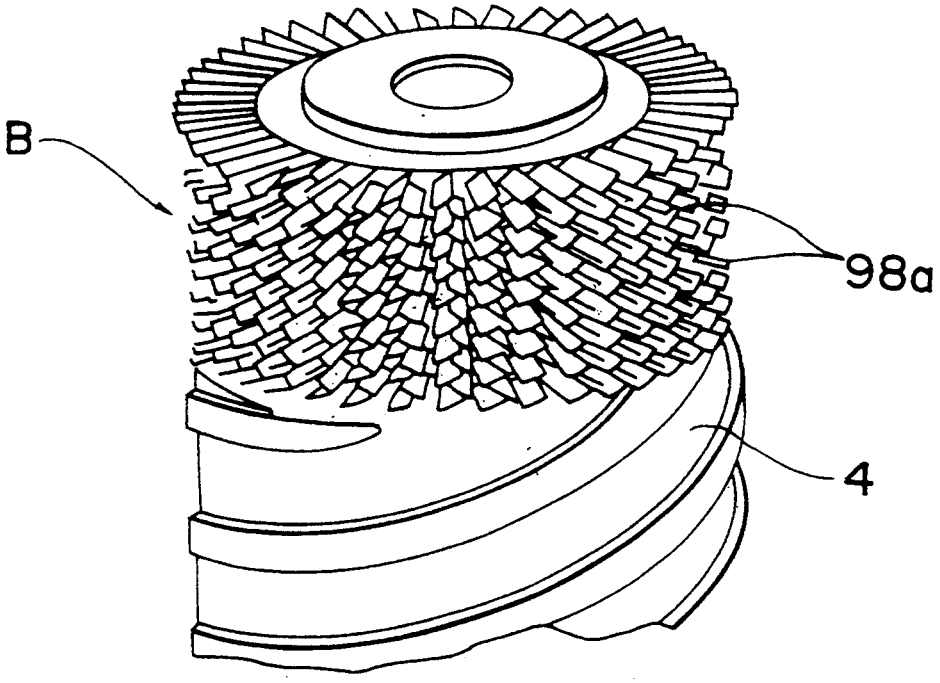
FIG. 7B is a perspective view of an example of a turbine blade in FIG. 7A.

A second embodiment of the present invention is described below with reference to FIG. 7A. A very low degree of ultimate pressure as low as $10^{-7}$ to $10^{-8}$ Pa can be generated by providing the high vacuum-generating pump (B) and/or high pumping speed pump (C) with a turbine blade 98. A turbine blade 98*a* shown in FIG. 7B can be used as the above turbine blade 98, for example.

Figure 8:
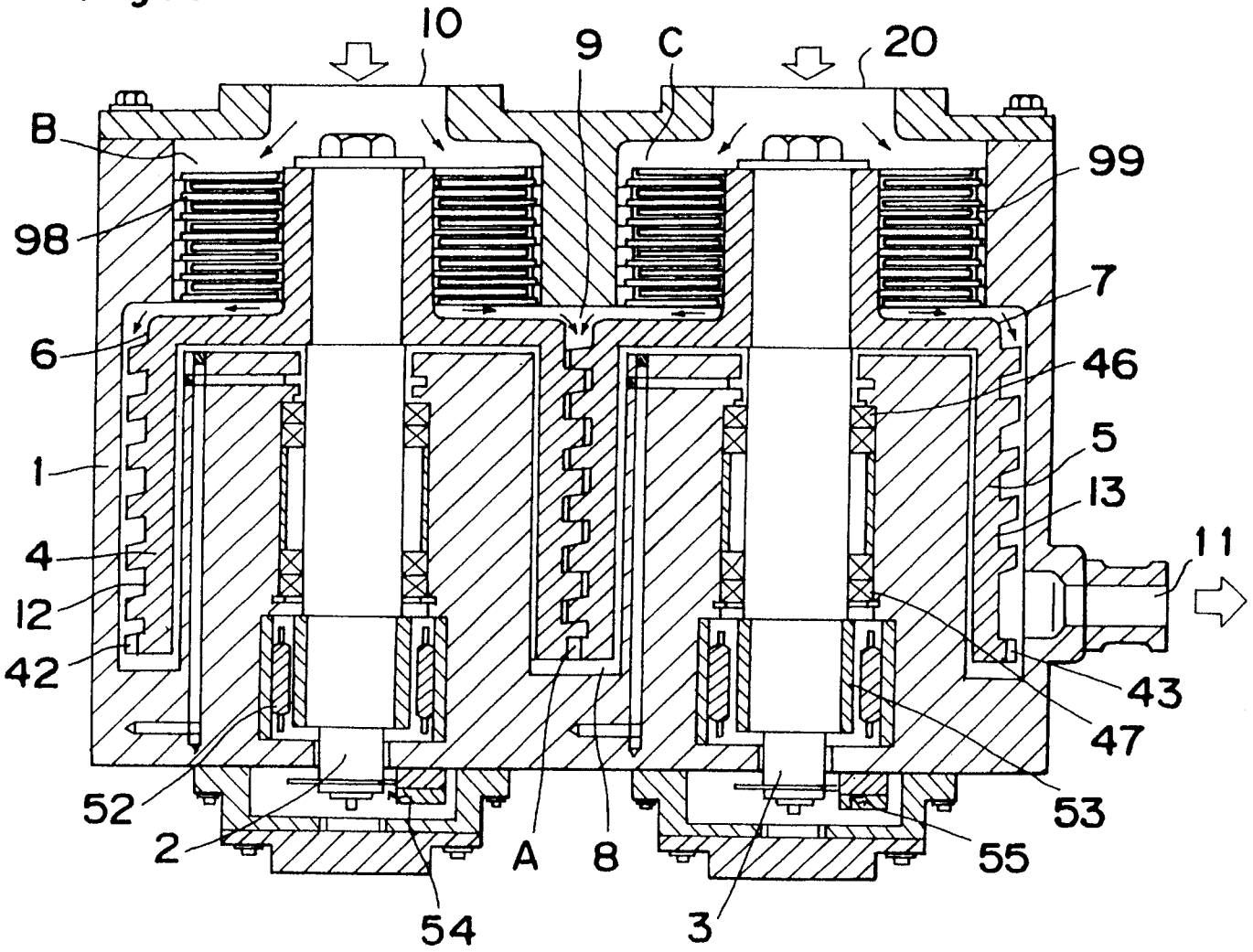
FIG. 8 is a sectional view showing a vacuum pump according to a third embodiment of the present invention.

A third embodiment of the present invention is described below with reference to FIG. 8. The high vacuum-generating pump (B) and the high pumping speed pump (C) are respectively provided with turbine blades according to the following criteria:

(1) With to the turbine blade of the high vacuum-generating pump (B), the lowest ultimate pressure is obtained when gas such as hydrogen or helium having a small molecular weight is sucked.

(2) With to the turbine blade of the high pumping speed generating pump (C), the lowest ultimate pressure is obtained when gas such as air or nitrogen having a large molecular weight is sucked.

The vacuum pump having the turbine blades according to the above criteria (1) and (2) according to the third embodiment, is capable of generating a higher vacuum than the conventional kinetic vacuum pump within a wider range of molecular weights than the conventional one in the conventional vacuum pump. It is not necessary to form the suction opening on both the high vacuum-generating pump (B) and the high pumping speed pump (C), but may be formed only on the former or the latter.

According to a book entitled "Physics of Vacuum and Application Thereof" written by Mr. Norio Kumagai, Goro Tominaga, Yasushi Tsuji, and Genichi Horikoshi, (1) In order to increase pumping speed, $30°<\alpha<40°$ is effective.

(2) In order to reduce ultimate pressure, $10°<\alpha<20°$, is effective.

(3) When the molecular weight of sucked gas such as hydrogen or helium is small, ultimate pressure is high.

(4) When the molecular weight of sucked gas such as air or halogen is great, pumping speed is small.

Figure 7C:
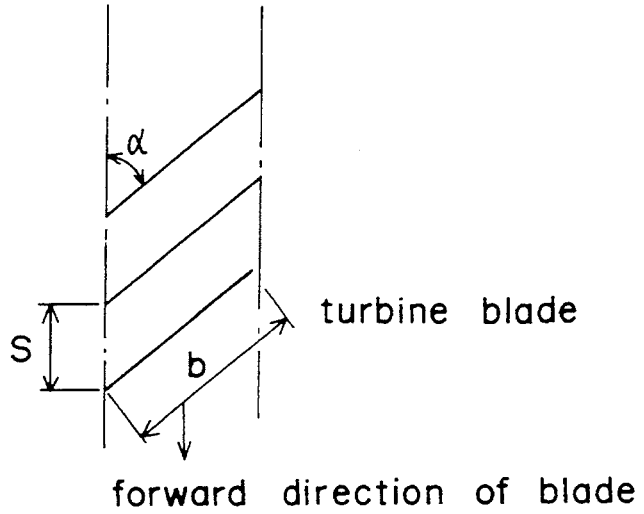
FIG. 7C is a view used for defining $\alpha$ of a turbine blade.

Therefore, when the molecular weight of gas is small, preferably, $10°<\alpha<20°$. When the molecular weight of gas is great, preferably, $30°<\alpha<40°$. In the above, "$\alpha$" is the inclination of the turbine blade as shown in FIG. 7C. Supposing that the length of the turbine blade is "b" and the pitch between adjacent turbine blades is "s", $s=b\sin\alpha$. Therefore, with an increase of $\alpha$, the length of the turbine blade becomes short supposing that the "s" is constant.

As apparent from the foregoing description, the housing accommodates the positive displacement vacuum pump structure section and a plurality of kinetic vacuum pump structure sections having different constructions. Therefore, the vacuum pump according to the present invention provides a high vacuum and a high pumping speed although it is compact.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A vacuum pump comprising:

a housing;

a plurality of rotors accommodated in said housing and having a plurality of rotary shafts, respectively;

a plurality of bearings for supporting said rotary shafts, respectively;

a fluid-sucking opening and a fluid-discharge opening formed in the housing;

a plurality of motors for driving said rotors, respectively; and a plurality of control means for respectively controlling said motors so that the motors rotate synchronously, whereby fluid is sucked and discharged by utilizing change in the volume of a space formed by the rotors and the housing;

a positive displacement vacuum pump structure section disposed on the discharge side of each rotor; and a plurality of kinetic vacuum pump structure sections disposed on the sucking sides of said rotors, respectively;

wherein a part of each of the kinetic vacuum pump structure sections has a thread groove; and wherein the kinetic vacuum pump structure sections are different relative to one another in one of depth of the thread grooves, width of the thread grooves, width of threads, and number of threads.

2. The vacuum pump as claimed in claim 1, further comprising a means for detecting rotary angles and numbers of rotations of the motors, the control means being operable to respectively control said motors based on signals outputted from the detecting means.

3. The vacuum pump as claimed in claim 1, wherein a part of each of the kinetic vacuum pump structure sections has a thread groove, and the pump further comprises a means for detecting rotary angles and numbers of rotations of the motors, the control means being operable to control said motors based on signals outputted from the detecting means.

4. The vacuum pump as claimed in claim 1, further comprising a means for detecting rotary angles and numbers of rotations of the motors, the control means being operable to control said motors based on signals outputted from the detecting means; and wherein a part of each of the kinetic vacuum pump structure sections has a thread groove and the kinetic vacuum pump structure sections are different relative to one another in one of depth of the thread grooves, width of the thread grooves, width of threads, and number of threads.

5. A vacuum pump comprising:

a housing;

a plurality of rotors accommodated in said housing and having a plurality of rotary shafts, respectively;

a plurality of bearings for supporting said rotary shafts, respectively;

a fluid-sucking opening and a fluid-discharge opening formed in the housing;

a plurality of motors for driving said rotors, respectively; and a plurality of control means for respectively controlling said motors so that the motors rotate synchronously, whereby fluid is sucked and discharged by utilizing change in the volume of a space formed by the rotors and the housing;

a positive displacement vacuum pump structure section disposed on the discharge side of each rotor; and a plurality of kinetic vacuum pump structure sections disposed on the sucking sides of said rotors, respectively; and wherein the kinetic vacuum pump structure sections have thread grooves, respectively, which are different relative to one another in one of depth of the thread grooves, width of the thread grooves, width of threads, and number of threads, so that one of the kinetic vacuum pump structure sections has a thread groove which is so configured as to obtain a high vacuum and another of the kinetic vacuum pump structure sections has a thread groove which is so configured as to obtain a large pump speed.

* * * * *